US006765306B2

(12) United States Patent
Fattic

(10) Patent No.: US 6,765,306 B2
(45) Date of Patent: Jul. 20, 2004

(54) METHOD FOR INTERNALLY JUMP STARTING AN INTERNAL COMBUSTION ENGINE FOR A LAND-BASED VEHICLE

(75) Inventor: Gerald Thomas Fattic, Fishers, IN (US)

(73) Assignee: Delphi Technologies, Inc., Troy, MI (US)

( * ) Notice: Subject to any disclaimer, the term of this patent is extended or adjusted under 35 U.S.C. 154(b) by 88 days.

(21) Appl. No.: 10/228,763

(22) Filed: Aug. 27, 2002

(65) Prior Publication Data

US 2004/0041403 A1 Mar. 4, 2004

(51) Int. Cl.[7] ..... F02N 11/06
(52) U.S. Cl. ..... 290/40 C; 290/32; 320/110
(58) Field of Search ..... 290/40 C, 32; 320/110, 126; 318/762

(56) References Cited

U.S. PATENT DOCUMENTS 4,045,718 A * 8/1977 Gray ..... 320/123
4,757,249 A * 7/1988 Farber et al. ..... 320/126
5,083,077 A * 1/1992 Wallace et al. ..... 322/32
5,151,641 A * 9/1992 Shamoto ..... 318/762
5,233,229 A * 8/1993 Kohl et al. ..... 307/10.1
5,355,071 A * 10/1994 Ishida et al. ..... 320/110
5,698,905 A * 12/1997 Ruthlein et al. ..... 290/32
6,037,752 A 3/2000 Glennon ..... 322/22
6,211,577 B1 4/2001 Alksnat et al. ..... 290/37 R
6,243,277 B1 6/2001 Sun et al. ..... 363/65
6,268,666 B1 7/2001 Bhowmik ..... 307/72
6,335,574 B1 * 1/2002 Ochiai et al. ..... 290/40 C

* cited by examiner

*Primary Examiner*—Nicholas Ponomarenko
(74) *Attorney, Agent, or Firm*—Jimmy L. Funke

(57) ABSTRACT

Method and system are provided that allow determining in a vehicle having two or more sources of electrical energy what corrective action needs to be undertaken in the event one of the energy sources, due to malfunctions and/or environmental conditions, is not able to carry through a cranking event. The system, by way of a bidirectional DC/DC converter, has the capability to transfer electrical energy in either direction between the energy sources. The system includes a controller configurable with computer-readable logic or intelligence that enables the controller to make a decision based on appropriate source parameters, e.g., temperature, to automatically determine when, where, and how much energy needs to be transferred. This decision will enhance the opportunity to successfully perform the next starting or cranking event.

17 Claims, 4 Drawing Sheets

METHOD FOR INTERNALLY JUMP STARTING AN INTERNAL COMBUSTION ENGINE FOR A LAND-BASED VEHICLE

FIELD OF THE INVENTION

This invention relates to jump starting techniques for a land-based vehicular propulsion system equipped with two or more sources of electrical energy.

BACKGROUND OF THE INVENTION

A wide variety of devices, such as jump starters and battery chargers, are known for starting vehicles that have a dead battery and for charging batteries. Unfortunately, such devices are generally external to the vehicle, and thus, assuming the operator has access to such an external device, the operator needs to go through cumbersome procedures to safely connect the jumper wires to perform the jump-starting.

In vehicles that use two or more sources of electrical energy, it would be desirable to provide self-contained jump-starting techniques that are quick, reliable, convenient, foolproof, and inexpensive for internally jump starting and charging any source that may be experiencing a fault, such as low-voltage condition, in order to successfully perform a cranking event.

BRIEF SUMMARY OF THE INVENTION

In accordance with aspects of the present invention, method and system are provided that allow determining in a vehicle having two or more sources of electrical energy what corrective action needs to be undertaken in the event one of the energy sources, due to malfunctions and/or environmental conditions, may not be able to carry through a cranking event. The system, by way of a bi-directional DC/DC converter, has the capability to transfer electrical energy in either direction between the energy sources. The system includes a controller configurable with computer-readable logic or intelligence that enables the controller to make a decision based on appropriate source parameters, e.g., temperature, to automatically determine when, where, and how much energy needs to be transferred. This decision will enhance the opportunity to successfully perform the next starting or cranking event.

Generally, the present invention fulfills the foregoing needs by providing in one aspect thereof a method for automatically jump-starting an internal combustion engine (e.g., gasoline or diesel engine) of a land-based vehicle using equipment on-board the vehicle. The method allows providing at least two distinct sources of electrical energy on-board the vehicle. The method further allows monitoring each of the at least two distinct sources to determine the occurrence of a fault condition in any respective one of the two sources. The fault condition may be indicative of inability of the one source to perform an engine cranking event. A determination is made as to whether a state-of-charge in the other one of the two sources is sufficient to supply an amount of electrical energy selected for re-energizing the respective one of the two sources with the fault condition to a predetermined level of re-energization in order to successfully perform the engine cranking event. A re-energization strategy is selected based on the respective characteristics of the source to supply the electrical energy relative to the source to be re-energized. An engine cranking event is performed to start the internal combustion engine of the vehicle. The cranking event is performed once the one source being re-energized has reached the predetermined level of re-energization.

The present invention further fulfills the foregoing needs by providing in another aspect thereof, a system for automatically jump-starting an internal combustion engine of a land-based vehicle using equipment on-board the vehicle.

The system includes at least two distinct sources of electrical energy on-board the vehicle. The system further includes a monitor configured to monitor each of the at least two distinct sources to determine the occurrence of a fault condition in any respective one of the two sources. The fault condition is generally indicative of inability of the one source to perform an engine cranking event. A controller is configured to determine whether a state-of-charge in the other one of the two sources is sufficient to supply an amount of electrical energy selected for re-energizing the respective one of the two sources with the fault condition to a predetermined level of re-energization in order to successfully perform the engine cranking event. The controller is further configured to select a re-energization strategy based on the respective characteristics of the source to supply the electrical energy relative to the source to be re-energized, and wherein an engine cranking event is performed to start the internal combustion engine of the vehicle once the one source being re-energized has reached the predetermined level of re-energization.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
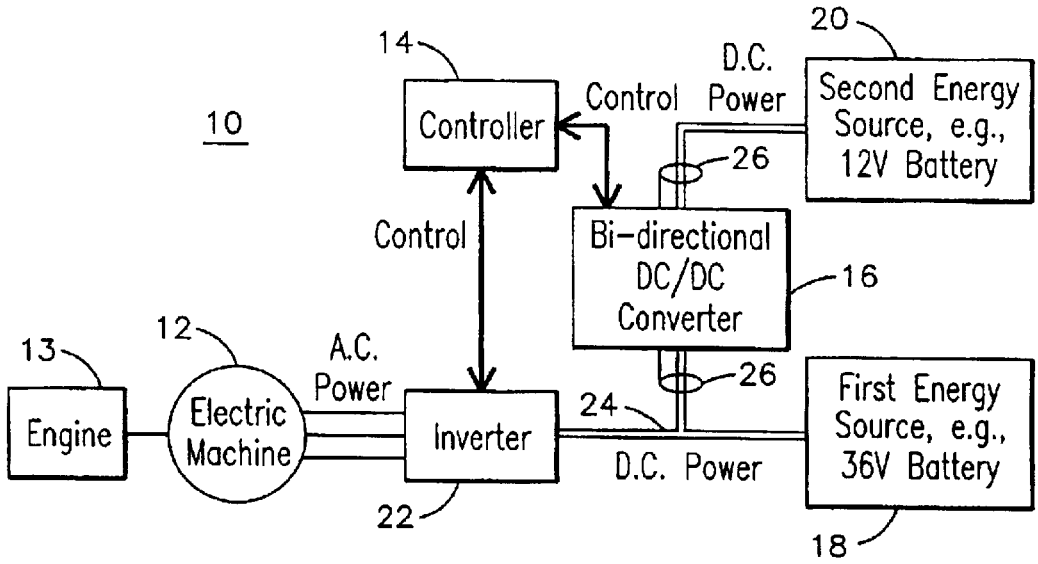
FIG. 1 is a block diagram representation of an exemplary propulsion system equipped with at least two distinct sources of electrical energy, which system may benefit from the jump-starting techniques of the present invention.

FIG. 1 is a block diagram representation of an exemplary propulsion system that may benefit from the teachings of the present invention. One such exemplary system purveyed by the assignee of the present invention for land-based vehicular applications is referred to in commerce as Energen™ propulsion system and may be made up of an electric machine 12 (e.g., AC induction machine, permanent magnet machine, etc.) mechanically coupled to an internal combustion engine 13, such as spark-ignited engines that, for example, may use gasoline as the source of fuel, or compression and temperature-ignited engines that, for example, may use diesel as the source of fuel. System 10 is further made up of a controller 14, a bi-directional DC/DC converter 16, a first energy source 18 of electrical power, e.g., a 36V battery, and a second energy source 20 of electrical power, e.g., a 12V battery.

It will be appreciated that the type, number, and voltage level of the sources described herein should not be construed as limiting the present invention but should be construed just as illustrations. For example, as will be now recognized by those skilled in the art, the number of sources could be more than two; the voltage levels provided by the sources could be any voltage level suitable to any given application; and the type of electrical sources could be other than batteries, such as ultracapacitors or flywheels or any combination of such sources. In the event DC-to-AC conversion is desired, an inverter 22 may be used to change a dc input voltage, as may be supplied by way of a dc bus 24, to an ac output voltage of desired magnitude and frequency using techniques well-understood by those skilled in the art. The electric machine has the capability of cranking or starting the engine during a cranking event. The controller may provide the signals for controlling the bi-directional converter and for driving the electric machine, for example, through inverter 22.

In accordance with aspects of the present invention, controller 14 may be configured, by way of a monitor 26 (e.g., voltage and/or current monitoring of each of the first and second energy sources), to determine what corrective action needs to be undertaken in the event one of the energy sources, due to malfunctions and/or environmental conditions, may not be able to carry through a cranking event. In one exemplary embodiment, one of the energy sources, e.g., the 36V battery, may be configured to normally provide the power to start the engine and the other energy source, e.g., the 12V battery, may be configured to normally provide power to auxiliary loads in the vehicle.

As suggested above, controller 14 has the capability to automatically take corrective action if the engine fails to start due to a low-energy condition in any of the energy sources. For example, if a low-voltage fault occurs in the 12 V or the 36 V battery during a cranking or starting event, then, as further elaborated below, the controller may determine to transfer energy from an appropriately energized energy source to the one with the low-voltage fault. The system, by way of bi-directional DC/DC converter 16, has the capability to transfer electrical energy in either direction between the energy sources. For readers desirous of background information regarding an exemplary bi-directional DC/DC converter, reference is made to U.S. patent application Ser. No. 10/012,836, filed on Dec. 10, 2001, titled "Bi-directional DC/DC Converter and Control Method Therefor", which application is assigned in common to the same assignee of the present invention and is herein incorporated by reference in its entirety.

In accordance with aspects of the present invention, the controller includes computer-readable logic or intelligence that enables the controller to make a decision based on appropriate battery parameters and automatically determine when, where, and how much energy needs to be transferred. This corrective action will enhance the opportunity to successfully perform the next starting or cranking event.

Determination for Performing Internal Charging

Figure 2:
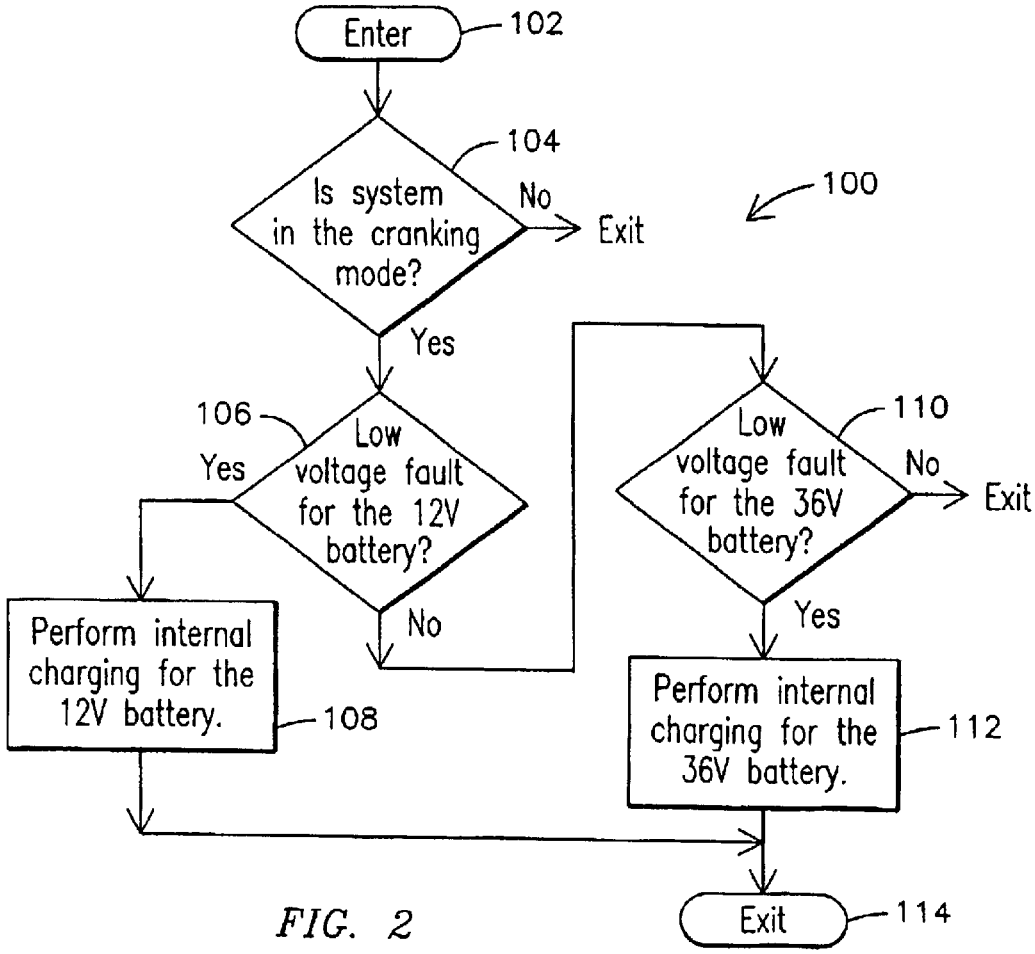
FIG. 2 is a flow chart of a process for determining whether or not internal charging of one of the sources of electrical energy in FIG. 1 is required to successfully carry out a cranking event.

FIG. 2 is a flow chart of a process 100 for determining whether or not internal charging of one of the sources of electrical energy is required to successfully carry out a cranking event. During the starting or cranking mode, the controller may monitor both the 12 V battery and the 36 V battery to determine the occurrence of conditions that could result in a failed cranking event. For example, if any battery falls below a respective threshold voltage value, a low voltage fault may be set for that battery. This fault information may be used to determine what corrective action needs to be taken. Subsequent to entering or initiating an internal charging determination at 102, decision block 104 allows determining whether the propulsion system is in a cranking mode. Assuming the propulsion system is in a cranking mode, decision block 106 allows determining whether a fault, e.g., a low-voltage fault, has occurred in the 12 V battery. If the answer from decision block 106 is yes, then at block 108 the controller 14 (FIG. 1) would issue a command to perform internal charging for the 12 V battery. Conversely, if the answer from decision block 106 is no, then the process continues at decision block 110 for determining whether, for example, a low-voltage fault has occurred in the 36 V battery. If the answer from decision block 110 is no, then one would exit process 100 since each of the sources of electrical energy would have been found to be operating free from any faults that could have resulted in a failed cranking event. If the answer from decision block 110 is yes, then at block 112, prior to exiting action 114, the controller would issue a command to perform internal charging for the 36 V battery. It will be appreciated that the sequence of which energy source is checked first is of no consequence, and, in general, the fault checking could performed in any desired order.

Internal Charging for One of the Energy Sources, e.g., the 12V Battery

Figure 3:
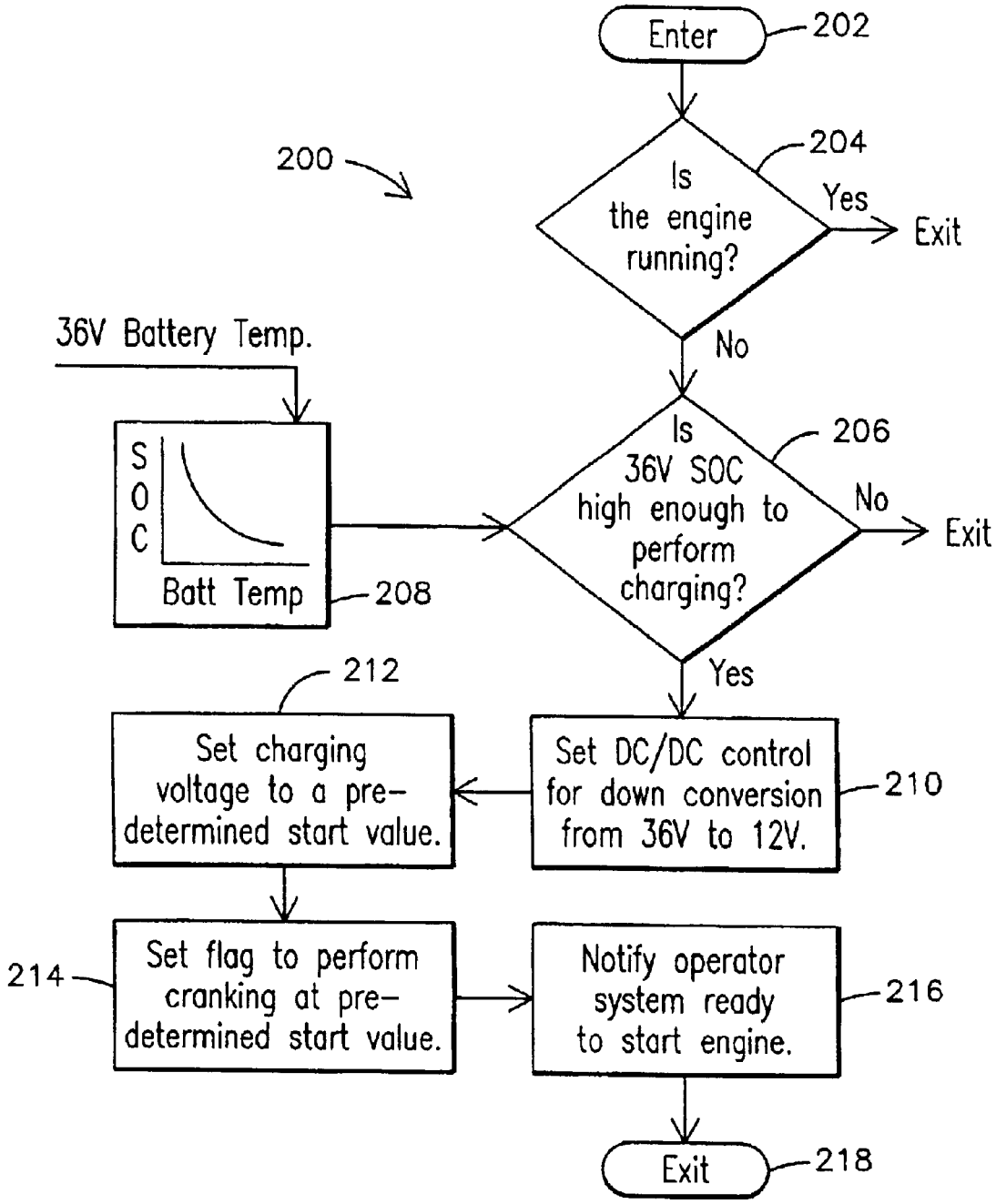
FIG. 3 is a flow chart of a process for performing internal charging for one of the electrical sources (e.g., the 12 V battery) in the event such electrical source exhibits a low-voltage fault.

FIG. 3 is a flow chart of a process 200 for performing internal charging for one of the electrical sources (e.g., the 12 V battery) in the event that such electrical source exhibits a low-voltage fault. Subsequent to entering the process at 202, decision block 204 allows checking whether or not the engine is running. That is, block 204 allows determining the need of performing a cranking event. If the engine is running, one would exit process 200 since there is no need to perform a cranking event. If the engine is not running, the actual state of charge (SOC) of the 36 V battery may be compared at 206 relative to reference data indicative of a nominal SOC value as may be stored in a look-up table 208. The nominal SOC value may vary as a function of environmental and/or operational conditions of the battery. For example, look-up table 208 may be used for storing reference SOC values that vary as a function of battery temperature. Thus, block 206 allows determining whether or not the 36 V battery has a sufficiently high SOC value to perform charging of the 12 V battery without creating a potentially damaging condition onto itself For example, if the SOC of the 36 V battery is too low, and one were to proceed to charge the 12 V battery, this could result both in a failed cranking event, and in damage to the 36 V battery. If the SOC value of the 36 V battery is not sufficiently high, then one would exit process 200 since this would indicate that there is no energy source presently available to perform the cranking event. If the 36 V battery SOC value is high enough to perform the charging of the 12 V battery, then at 210 the DC/DC converter would be set by the controller to convert power (bucking mode) from the 36 V battery to be supplied to the 12 V battery. At 212, the DC/DC converter would be set to charge the 12 V battery to some predetermined start voltage level, such as a minimum voltage level, that will allow the 12 V battery to successfully carry out the cranking event without unnecessarily depleting the 36 V battery. At 214, a flag may be set once the 12 V battery has been charged to the predetermined start voltage level. Prior to exiting the process at 218, block 216 allows notifying the operator that the system is ready to start the engine.

Internal Charging for Another One of the Energy Sources, e.g., the 36 V Battery

Figure 4:
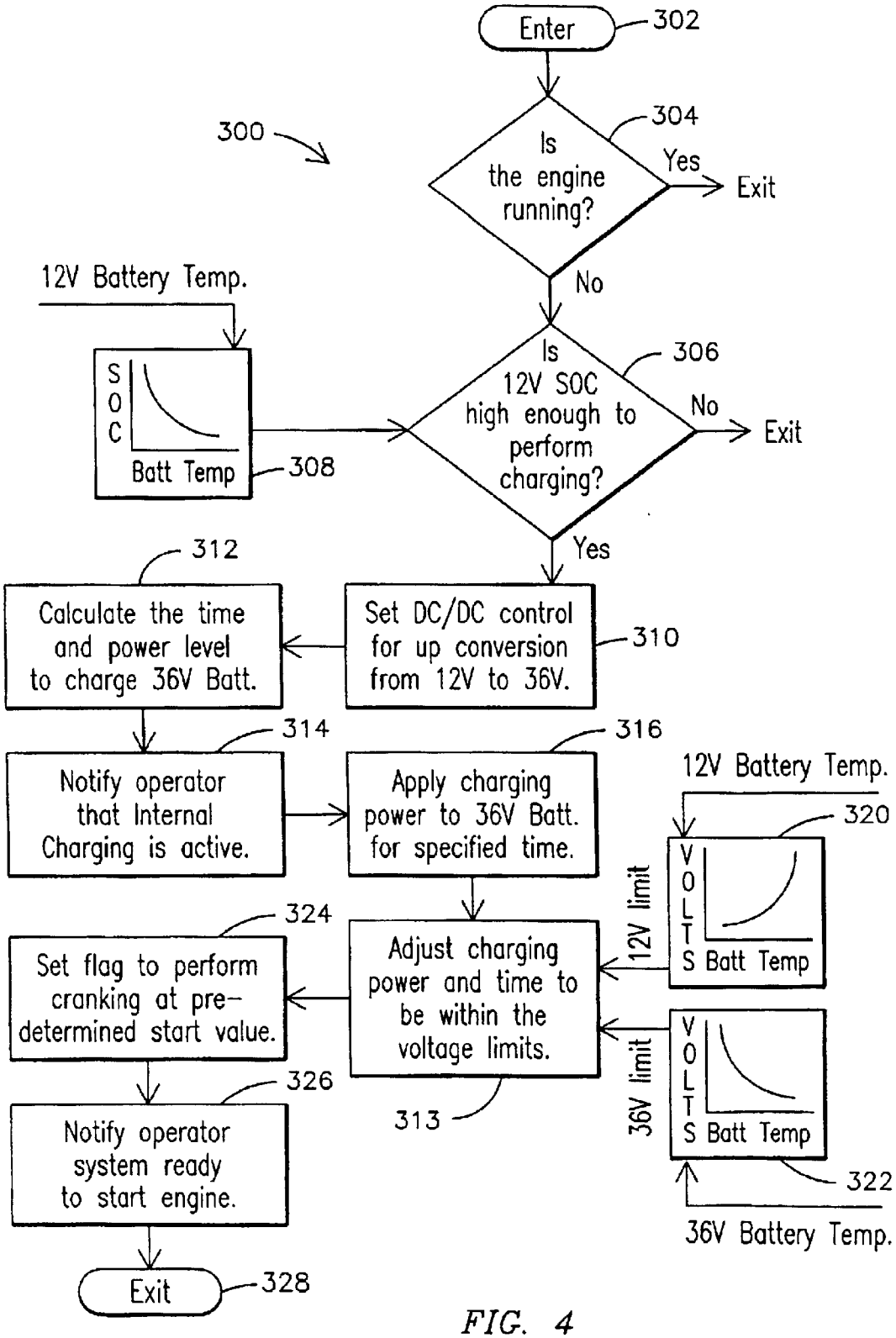
FIG. 4 is a flow chart of a process for internally charging another one of the sources of electrical energy (e.g., the 36 V battery) in the event such electrical source exhibits a low-voltage fault.

FIG. 4 is a flow chart of a process 300 for internally charging another one of the sources of electrical energy (e.g., the 36 V battery), in the event that such electrical source exhibits a low-voltage fault. Subsequent to entering the process at 302, decision block 304 allows checking whether or not the engine is running. If the engine is running, one would exit process 300 since there is no need to perform a cranking event. If the engine is not running, the actual state of charge (SOC) of the 12 V battery may be compared at 306 relative to reference data indicative of a nominal SOC value as a function of environmental and/or operational conditions of the battery. For example, a look-up table 308 may be used for storing SOC reference values as a function of battery temperature. Thus, block 306 allows determining whether or not the 12 V battery has a sufficiently high SOC value to perform charging of the 36 V battery. As suggested above, the idea is to avoid both an unsuccessful cranking event and the possibility of damaging the charging source. If the state of charge of the 12 V battery is high enough to perform charging of the 36 V battery then, at 310, the DC/DC converter is activated to deliver power (boosting mode) from the 12 V battery to the 36 V battery. At block 312, the controller maybe configured to determine the amount of time and power level needed for charging the 36 V battery. At 314, the operator may be notified that internal charging of the 36 V battery is active. At 316, charging power is applied to the 36 V battery for the amount of time and at the power level determined by the controller. At 318, the charging power and time can be adjusted to operate within respective voltage limits of the 12V and 36V batteries, as may be determined by monitors 320 and 322, that may be configured to take into account respective operational and/or environmental conditions of each battery, such as battery temperature. For example, if the voltage of the 12V battery falls below its respective limit, the charging power will be reduced to meet the 12V-voltage limit. In some cases, this may result in lengthening the charging time. However, as suggested above, the idea is that performing the internal charging should not result in damaging the charging source. Any such lengthening of time may be communicated to the operator so that in the event the charging time exceeds the expectations of the operator, then the operator may seek alternative techniques for charging the source. Conversely, if the voltage of the 36V battery exceeds the 36V-voltage limit, the charging power will be reduced to meet the 36V-voltage limit. Thus, this aspect of the invention allows balancing the needs of both the supplying source as well as those of the recipient source.

At 324, a flag could be set to indicate that the time and power level for charging the 36 V battery have been reached. In one exemplary embodiment the time and power level for charging the 36 V battery may be chosen to provide a minimum energy start that will require less energy from the 36V battery than would be the case under a full-power quick start. The amount of time and power level to charge the 36 V battery may be determined by the respective capacities of the 12 V and 36 V batteries and the amount of energy required to perform a minimum energy start in a given propulsion system. Prior to exiting the process at 328, block 326 allows notifying the operator that the internal charging of the 36 V battery has been performed and the system is ready to start the engine.

Internal Jump-Starting Using Combination of Sources

Figure 5:
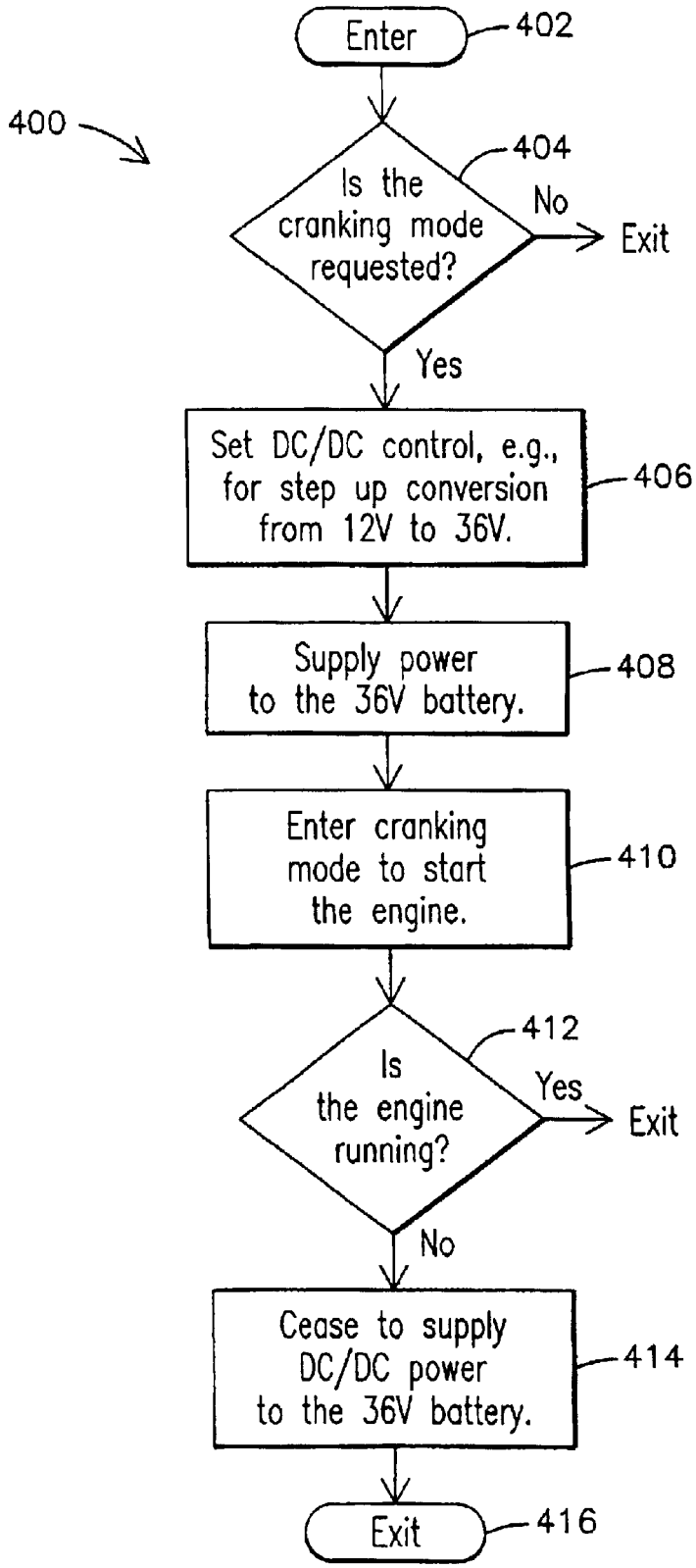
FIG. 5 is a flow chart of a process that allows one of the energy sources of electrical energy to supplement the other energy source in the event such other energy source is in a weakened mode.

FIG. 5 is a flow chart of a process 400 that allows one of the energy sources of electrical energy to supplement the other energy source in the event such other energy source is in a weakened mode. By way of example, the flow chart of FIG. 5 assumes that the energy source that will be supplemented is the 36 V battery. It will be appreciated, however, that this aspect of the present invention is not limited to providing supplemental power to the 36 V battery since the same principles would be similarly applicable to the 12 V battery, in case the 12 V battery needed supplemental power. Subsequent to entering process 400 at 402, block 404 allows determining whether or not a cranking mode is requested. In the event a cranking mode is requested, block 406 allows the DC/DC converter to provide step-up conversion from 12 V to 36 V. Block 408 allows for supplying power to the 36 V battery from the 12 V battery. That is, combining the respective power capabilities of the two sources. Block 410 allows entering into a cranking mode to start the engine. The decision block 412 allows determining whether or not the engine is running. If the engine is running, then a successful cranking event just occurred and one exits process 400. If the engine is not running, then block 414 allows stopping supply of electrical power to the 36 V battery prior to the exiting process at exiting action 416 since in this case the combined power of the two sources was not sufficient to perform the cranking event.

Table 1 below shows simulation results using the Energen system as an example of a propulsion system equipped with multiple energy sources. The target cranking speed for the engine is assumed to be 125 rpm with a torque of 160 Nm being applied. The system cranking efficiency is assumed to be 35%. The resulting crankshift power would be 2080 watts. The electric power consumed would be 5,943 watts. The energy consumed for ten seconds would be 59,429 joules. The power converter efficiency is assumed to be 90%. The efficiency for power acceptance into the 36V battery is assumed to be 90%.

TABLE 1

| | | | | | |
|---|---|---|---|---|---|
| Target speed | 125 | rpm | | | |
| Target torque | 160 | Nm | | | |
| crankshaft pwr | 2080 | watts | | | |
| System Eff | 0.35 | at cranking | | Time to charge (sec) | |
| Elec power | 5943 | watts | | 97.8 | |
| Cranking Time | 10 | seconds | | | |
| energy | 59429 | joules | | | |
| Batt charg eff | 0.90 | | | | |
| up conv eff | 0.9 | | | | |
| 12 V batt power | 750 | watts | 12 V battery | 68.2 | amps |
| | | | 36 V battery | 16.1 | amps |
| amp-hr | 12 V delta % SOC | 36 V delta % SOC | | | |
| 10 | 18.53 | 4.85 | | | |
| 15 | 12.35 | 3.23 | | | |
| 20 | 9.26 | 2.43 | | | |
| 25 | 7.41 | 1.94 | | | |
| 30 | 6.18 | 1.52 | | | |
| 35 | 5.29 | 1.39 | | | |
| 40 | 4.63 | 1.21 | | | |

As can be appreciated from the tabulation in Table 1, one exemplary time period for replacing the cranking energy for a ten second cranking event would be 97.8 seconds. The discharge current from the 12 V battery would be 68.2 amperes {assuming a 11.0 volt terminal voltage} and the charging current for the 36 V battery would be 16.1 amperes {assuming a 42.0 volt terminal voltage}. The table also shows exemplary change in state of charge (SOC) for the 12

V and 36 V batteries at different ampere-hour capacities. The simulation shows that a charging time lasting just a few minutes should provide enough battery power for achieving a minimum energy start.

The present invention can be embodied in the form of computer-implemented processes and apparatus for practicing those processes. The present invention can also be embodied in the form of computer program code containing computer-readable instructions embodied in tangible media, such as floppy diskettes, CD-ROMs, hard drives, flash memories or any other computer-readable storage medium, wherein, when the computer program code (e.g., segment code) is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose computer, the computer program code segments configure the computer to create specific logic circuits or processing modules.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for automatically jump-starting an internal combustion engine of a land-based vehicle using equipment on-board the vehicle, the method comprising:

providing at least two distinct sources of electrical energy on-board the vehicle;

monitoring each of the at least two distinct sources to determine the occurrence of a fault condition in any respective one of the two sources, the fault condition generally indicative of inability of the one source to perform an engine cranking event;

determining whether a state-of-charge in the other one of the two sources is sufficient to supply an amount of electrical energy selected for re-energizing the respective one of the two sources with the fault condition to a predetermined level of re-energization in order to successfully perform the engine cranking event;

selecting a re-energization strategy based on the respective characteristics of the source to supply the electrical energy relative to the source to be re-energized;

performing an engine cranking event to start the internal combustion engine of the vehicle, the cranking event being performed once the one source being re-energized has reached the predetermined level of re-energization.

2. The jump-starting method of claim 1 wherein one of the distinct energy sources comprises a higher voltage source relative to the other energy source.

3. The jump-starting method of claim 2 wherein the re-energization strategy comprises stepping-down a voltage output from the higher-voltage source in the event said higher-voltage source is to supply the electrical energy relative to the source to be re-energized.

4. The jump-starting method of claim 2 wherein the re-energization strategy comprises stepping-up a voltage output from the source with a lower voltage in the event said lower-voltage source is to supply the electrical energy relative to the source to be re-energized.

5. The jump-starting method of claim 1 wherein the determining of whether the state-of-charge of the other source is sufficient to supply the amount of electrical energy for re-energizing the source with the fault condition further comprises monitoring at least one source parameter indicative of operational and/or environmental conditions of said other source, and using the source parameter to evaluate the sufficiency of the state-of-charge of said other source to achieve the predetermined re-energization level.

6. The jump-starting method of claim 1 wherein the re-energization strategy comprises calculating a time interval, and a power level to be applied during said time interval in order to meet the pre-determined re-energization level.

7. The jump-starting method of claim 6 wherein the re-energization strategy comprises monitoring whether both the source supplying electrical power and the source being re-energized are within respective voltage limit.

8. The jump-starting method of claim 7 further comprising adjusting the time interval and/or the power level applied during said time interval to ensure the source supplying electrical power and/or the source being re-energized is each within its respective voltage limits.

9. The jump-starting method of claim 1 wherein the re-energization strategy comprises adjusting the output voltage of one the sources relative to the voltage of the other source, and a combining of the two sources to enhance the probability of a successful cranking event.

10. A system for automatically jump-starting an internal combustion engine of a land-based vehicle using equipment on-board the vehicle, the system comprising:

at least two distinct sources of electrical energy on-board the vehicle;

a monitor configured to monitor each of the at least two distinct sources to determine the occurrence of a fault condition in any respective one of the two sources, the fault condition generally indicative of inability of the one source to perform an engine cranking event;

a controller configured to determine whether a state-of-charge in the other one of the two sources is sufficient to supply an amount of electrical energy selected for re-energizing the respective one of the two sources with the fault condition to a predetermined level of re-energization in order to successfully perform the engine cranking event, the controller further configured to select a re-energization strategy based on the respective characteristics of the source to supply the electrical energy relative to the source to be re-energized; and wherein an engine cranking event is performed to start the internal combustion engine of the vehicle once the one source being re-energized has reached the predetermined level of re-energization.

11. The jump-starting system of claim 10 wherein one of the distinct energy sources comprises a higher voltage source relative to the other energy source.

12. The jump-starting system of claim 11 further comprising a bi-directional converter configurable to step-down a voltage output from the higher-voltage source in the event said higher-voltage source is to supply the electrical energy relative to the source to be re-energized.

13. The jump-starting system of claim 11 further comprising a bi-directional converter configurable to stepping-up a voltage output from the source with a lower voltage in the event said lower-voltage source is to supply the electrical energy relative to the source to be re-energized.

14. The jump-starting system of claim 10 further comprising a monitor configured to monitor at least one source parameter indicative of operational and/or environmental conditions of said other source, and wherein the controller is configured to process the source parameter to evaluate the sufficiency of the state-of-charge of said other source to provide the predetermined re-energization level.

15. The jump-starting system of claim 10 wherein the controller is further configured to calculate a time interval, and a power level to be applied during said time interval in order to meet the pre-determined re-energization level.

16. The jump-starting system of claim 15 wherein the monitor for monitoring each of the at least two distinct sources is further configured to monitor whether both the source supplying electrical power and the source being re-energized are within respective voltage limits.

17. The jump-starting system of claim 16 wherein the controller is further configured to adjust the time interval and/or the power level applied during said time interval to ensure the source supplying electrical power and/or the source being re-energized is each within its respective voltage limit.

* * * * *